United States Patent [19]

Coons, Jr.

[11] Patent Number: 5,022,637

[45] Date of Patent: Jun. 11, 1991

[54] FINISHING APPARATUS FOR USE WITH ELECTRONIC PRINTERS

[75] Inventor: Robert A. Coons, Jr., Holcomb, N.Y.

[73] Assignee: Xerox Corporation, Stamford, Conn.

[21] Appl. No.: 427,545

[22] Filed: Oct. 27, 1989

[51] Int. Cl.[5] ..... B42B 2/00

[52] U.S. Cl. ..... 270/53; 270/52

[58] Field of Search ..... 270/37, 53, 58; 355/324; 227/19, 99

[56] References Cited

U.S. PATENT DOCUMENTS 4,169,674 10/1979 Russell ..... 355/14
4,187,969 2/1980 Spehrley, Jr. ..... 227/2
4,509,732 4/1985 Kanno ..... 270/37
4,586,640 5/1986 Smith ..... 270/53

*Primary Examiner*—Edward K. Look
*Assistant Examiner*—Therese M. Newholm
*Attorney, Agent, or Firm*—William A. Henry, II

[57] ABSTRACT

A finishing apparatus to be used with computer driven or IOT type printers that deliver copy sheets 1-N face-down includes an inverted stapler. A copy sheet set is brought into contact with the clamping surface of a fixed head of the stapler. After the copy sheet set is secured against the clamping surface, a staple is driven therethrough.

3 Claims, 1 Drawing Sheet

FINISHING APPARATUS FOR USE WITH ELECTRONIC PRINTERS

Figure 1:
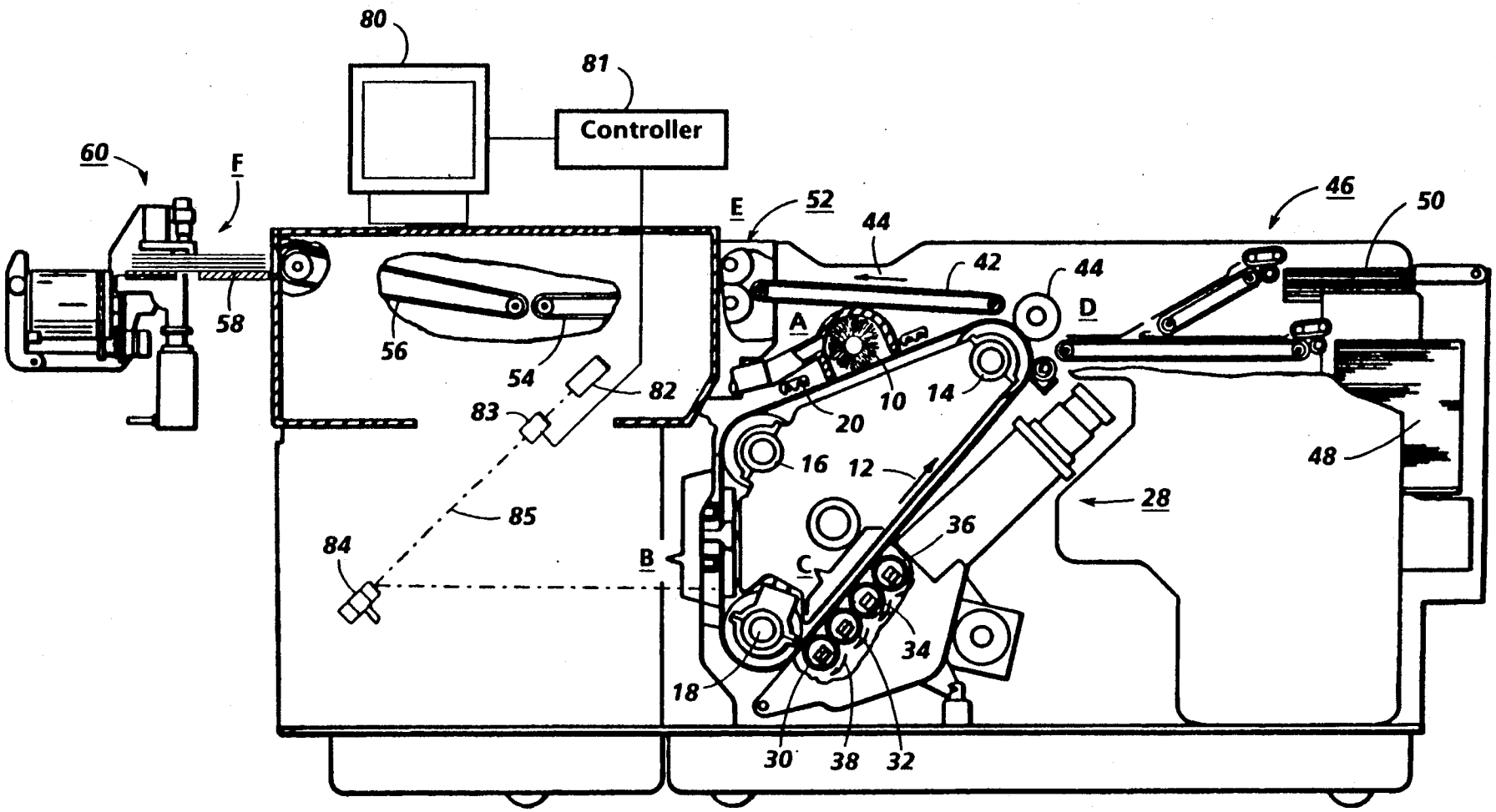

This invention relates to finishing, and more particularly concerns properly stapling copy sets exiting a printer face-down.

Generally, typical data output flow from a computer controlled electronic printer is sheets 1 to N, i.e., sheet 1, side 1 is first out; then sheet 2, side 1; sheet 3, side 1, etc. In the case of computer fed printers that delivery copy sheets printed side down in the finisher or face-down in orientation, the normal output of copy sheets to the finisher is as the page image information is inputted from the computer with sheet 1, side 1, being face-down in the finisher with the rest of the particular copy sheet set resting on top of sheet 1.

If the above copy sheet set is to be stapled with any conventional stapler, the staples would physically enter the top of the stack and be clinched or folded on the bottom of the stack. With the staples being clinched on the bottom of the stack this would be onto sheet 1 in the stack. Thus, the staples in the stack would be backward. This is unacceptable for professional papers, therefore, instead of using the stapler or stitcher in present finishers, industry practice has been to remove the copy sheet sets from the finisher, invert them and then place them into a stapler apparatus separate from the printer for stapling. Obviously, it would be extremely valuable to be able to eliminate this second step of placing copy sets delivered face-down into a second finishing apparatus and instead staple the copy sets within the finisher of the printer.

Accordingly, and in accordance with the present invention proper orientation of staples into copy sheet sets delivered to a finishing apparatus sheets 1–N face-down is accomplished by inverting a stapler, i.e., placing staples into the copy sheet set from the bottom of the stack and clinching the staples on the top or backside of the stack.

Other advantages will become apparent after studying the following description taken in conjunction with the accompanying drawings wherein:

FIG. 1 is a schematic elevational view of a computer controlled laser printing machine and finisher incorporating the features of the present invention therein.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

In order to more fully understand the illustrative electrophotographic printing machine incorporating the features of the present invention therein, reference is made to the drawings. In the drawings, like reference numerals have been used throughout to designate identical elements. FIG. 1 schematically illustrates the various components of an electrophotographic printing machine incorporating the stapling apparatus and method of the present invention therein. Although the stapling apparatus and method are particularly well adapted for use with an electrophotographic printing machine, it will become evident from the following discussion that it is equally well suited for use with a wide variety of machines and is not necessarily limited in its applications to the particular embodiment shown herein. The present invention is associated with a laser printer, preferably of the type presently in commercial use, labeled the 9790 ® Copier, manufactured by Xerox Corporation of Stamford, Connecticut. However, any other type of copier may be employed as long as copy sheets are processed and exit the copier face-down and 1–N.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface, e.g., a selenium alloy, deposited on a conductive substrate, e.g., aluminum, as shown in FIG. 1, belt 10 moves in the direction of arrow 12 to advance sequentially through the various processing stations positioned about the path of movement thereof. Rollers 14, 16 and 18 support belt 10. A drive mechanism, i.e., a suitable motor, is coupled to roller 14 and advances belt 10 in the direction of arrow 12.

Initially, a portion of the photoconductive surface of belt 10 passes through charging station A. Preferably charging station A includes a corona generating device, indicated generally by the reference numeral 20, to charge the photoconductive surface of belt 10 to a relatively high substantially uniform potential.

Next, the charged portion of the photoconductive surface of belt 10 advances through exposure station B. At exposure station B, controller 81 presents original document page image information to belt 10 by way of image signal input to acousto-optic modulator 83 which in turn modulates laser 82 to provide imaging beam 85. Beam 85 is scanned across belt 10 at exposure station B by mirrored facets of a rotating polygon 84 to image-wise expose belt 10 and create the electrostatic images represented by the image signal input to modulator 83.

Thereafter belt 10 advances the electrostatic latent image recorded thereon to development station C. At development station C, a developer unit 28 includes a plurality of magnetic brush developer rollers 30, 32, 34 and 36 disposed in housing 38. These developer rollers advance the developer mix into contact with the electrostatic latent image recorded on the photoconductive surface of belt 10. In a system of this type, a chain-like array of developer mix extends in an outwardly direction from each developer roller to contact the electrostatic latent image recorded on the photoconductive surface of belt 10. The latent image attracts the toner particles from the carrier granules forming a toner powder image on belt 10.

The toner powder images are transported by belt 10 to transfer station D. Transfer station D is located at a point of tangency on belt 10 as it moves around roller 14. A transfer roller 40 is disposed at transfer station D with the copy sheet being interposed between transfer roller 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Prior to proceeding with the remaining processing stations, the sheet feeding apparatus will be described briefly. The sheet feeding apparatus includes a sheet transport 46 which advances, in seriatim, successive copy sheets from stack 48, or, in lieu thereof, stack 50. The machine programming enables the operator to select the desired stack from which the copy sheet will be advanced. Thus, the selected copy sheet is advanced to transfer station D where the toner powder image adhering to the photoconductive surface of belt 10 is transferred thereto.

After the toner powder image has been transferred to the copy sheet, conveyor 42 advances the copy sheet in the direction of arrow 44 to fixing station E. Fixing station E includes a fuser assembly, indicated generally by the reference numeral 52. Fuser assembly 52 comprises a heated fuser roller and a back-up roll. The copy sheet having the toner powder image thereon passes between the fuser roll and back-up roll with the toner powder image contacting the fuser roll. In this manner, the toner powder image is permanently affixed to the copy sheet. After fusing, conveyors 54 and 56 advance the copy sheet to finishing station F.

Finishing station F includes an output tray 58 and an inverted stapling apparatus 60 in accordance with the present invention. The stapling apparatus includes one or two staplers each of which is manually adjustable to discrete positions corresponding to the paper sizes which may be used in the printing machine. Either staple or both staplers may be selected for stapling. Inasmuch as both staplers are identical to one another, only one stapler will be referred to hereinafter. The detailed structure of the stapling apparatus is described in U.S. Pat. No. 4,187,969 and is incorporated herein by reference to the extent necessary to practice the present invention. After all of the page image information from computer 80 has been reproduced, the stack of copy sheets in tray 58 are stapled to one another by stapling apparatus 60. Thereafter, the operator may remove the finished booklet or set of copy sheets therefrom. Although only one output tray is depicted, a plurality of such output trays may be employed as well as a corresponding number of staplers associated therewith.

Ordinarily, computer or information/output terminal (IOT) generated copy sheets are delivered to a finisher just as the page image information is in the computer, i.e., page 1–N. In order to have collated output from the computer driven printer, the copy sheets reflecting the computer page image data flow enters the finisher page 1–N imaged side down. Therefore, to staple this set of copies with a conventional stapler would be unacceptable because the staple would enter the stack through sheet N and be clinched onto sheet 1. Such an unacceptable finished copy sheet set is shown in U.S. Pat. No. 4,187,969 where a document handler of the type disclosed in U.S. Pat. No. 4,169,674 is employed to feed documents to an imaging station N–1, i.e., the document handler operates with the document pages stacked right-side-up in normal sequential order. The documents are removed from the bottom of the stack, presented face-down for copying, and returned again right-side-up to the top of the stack. As seen in FIG. 1 of U.S. Pat. No. 4,187,969, copy sheet output starts with sheet N (copy of the bottom document in the stack) and ends with sheet 1 (copy of the top document in the stack). Therefore, when the copy sheet set is stapled, the staples are clinched on the wrong side of the stack, i.e., on top of sheet 1. In contrast to this and in accordance with the present invention, copy sheets from computer generated, non-document handler type input to a printer are stapled with a stapler inverted with respect to most conventional staplers, i.e., the staples are placed into the copy sheet set from the bottom and clinched onto the top sheet in the set. This method of finishing a 1–N face-down copy sheet set is preferred because the staple enters side 1 of sheet 1 and exits side 2 of sheet N of a copy sheet set.

Thus, a method and apparatus has been disclosed that facilitates "on-line" finishing of copy sheet sets from computer generated data with staple(s) in the copy sheet sets being in proper orientation in relation to the normal data flow direction directly as the data is inputted to the printer or IOT, i.e., copy sheets 1–N face-down.

The present invention has been described in detail with particular reference to a preferred embodiment thereof; however, it should be understood that variations and modifications can be effected within the spirit and scope of the instant invention.

I claim:

1. A method for finishing copy set output from computer or input terminal generated data imaged page one thorough the last page (1–N) of a document and placing a staple or staples in the copy set in proper orientation, comprising the steps of:

receiving copy sheets in a finisher apparatus 1–N and face-down; and stapling the complete copy set with a stapler that is inverted with respect to normal positioning, such that the copy set is stapled from the bottom thereof.

2. A finishing apparatus adapted to staple/stitch a set of copy sheets delivered to the finisher apparatus 1–N and face-down, comprising: staple/stitch means positioned at a predetermined location within the finisher apparatus and wherein said staple/stitch means has a clinching portion positioned adjacent copy sheet N of the set such that the staple or stitch enters the copy sheet set from the bottom and exits through the top thereof.

3. A printing system that delivers collated copy sheet sets to a finishing apparatus thereof right-side-down in normal sequential order, and, wherein said finishing apparatus includes staple means adapted to place a staple or staples into the copy sheet sets from the bottom and clinch the staple or staples onto the top copy sheet in each copy sheet set.

* * * * *